US012799755B2

(12) United States Patent
Vegliante

(10) Patent No.: US 12,799,755 B2
(45) Date of Patent: Nov. 17, 2026

(54) POOL LIFESAVING DEVICE

(71) Applicant: Acqua Angel, LLC, Sarasota, FL (US)

(72) Inventor: Paul Vegliante, Franklin Lakes, NJ (US)

(73) Assignee: Acqua Angel, LLC, Sarasota, FL (US)

( * ) Notice: Subject to any disclaimer, the term of this patent is extended or adjusted under 35 U.S.C. 154(b) by 96 days.

(21) Appl. No.: 18/950,389

(22) Filed: Nov. 18, 2024

(65) Prior Publication Data

US 2025/0179824 A1 Jun. 5, 2025

Related U.S. Application Data

(60) Provisional application No. 63/606,128, filed on Dec. 5, 2023.

(51) Int. Cl.
*E04H 4/06* (2006.01)

(52) U.S. Cl.
CPC ..... *E04H 4/06* (2013.01)

(58) Field of Classification Search
CPC ..... E04H 4/065
USPC ..... 4/498
See application file for complete search history.

(56) References Cited

U.S. PATENT DOCUMENTS

| | | | | |
|---|---|---|---|---|
| 3,046,566 | A | 7/1962 | Berman | |
| 3,086,219 | A * | 4/1963 | Stafford | E04H 4/065 4/504 |
| 5,267,358 | A | 12/1993 | Roy et al. | |
| 5,832,547 | A | 11/1998 | Burroughs | |
| 8,001,626 | B2 | 8/2011 | Dalickas | |
| 10,810,857 | B1 | 10/2020 | Vegliante | |
| 11,348,435 | B2 | 5/2022 | Vegliante | |
| 11,531,136 | B2 | 12/2022 | Vegliante et al. | |
| 2013/0269097 | A1 * | 10/2013 | Alammari | E04H 4/065 4/495 |
| 2023/0279682 | A1 * | 9/2023 | Roberts | B66D 1/7447 4/495 |

* cited by examiner

*Primary Examiner* — Lauren A Crane
(74) *Attorney, Agent, or Firm* — Hoffmann & Baron, LLP

(57) ABSTRACT

A pool lifesaving device or system configured for use with a pool, includes: a safety net having a center portion and an outer perimeter; at least one weight disposed at the center portion of the safety net; cable lines or tethers engageable with portions of the outer perimeter of the safety net; and motors with spools for winding and unwinding the cable lines or tethers; where the safety net is configured to be disposed towards a floor of a pool when the cable lines or tethers are in an unwound configuration from the spool; and where the safety net is configured to be disposed above an upper edge of the pool when the cable lines are in a wound configuration from the spool.

16 Claims, 6 Drawing Sheets

POOL LIFESAVING DEVICE

CROSS-REFERENCE TO RELATED APPLICATIONS

This application claims the benefit of U.S. Provisional Application No. 63/606,128, filed Dec. 5, 2023, the contents of which is incorporated by reference herein.

FIELD OF THE INVENTION

The present invention is directed to a pool lifesaving device. More particularly, the present invention is directed to a safety net configured to be raised from a bottom of a pool to move a person in distress from out of the water of the pool.

BACKGROUND OF THE INVENTION

U.S. Pat. No. 3,046,566 disclosed a pool with frame having a net to prevent entry into a pool when the frame is in a raised position. The frame may be partially raised position to reduce the depth of accessible water for use of a pool with, for example, small children.

U.S. Pat. No. 5,267,358 discloses a web of cables configured to be raised from a bottom of a pool to prevent unwanted entry into the pool.

U.S. Pat. No. 5,832,547 discloses a safety net for a pool which is raised from the bottom of the pool upon infra red detection on an unwanted intruder into the pool.

U.S. Pat. No. 8,001,626 discloses a safety net disposed around the periphery of a swimming pool to prevent unwanted entry into the pool.

While preventing unwanted or undesirable entry into a pool is a notable safety concern, there is a need in the art to provide aid to a person in distress in a pool and to move the distressed person safety above the water line of the pool.

SUMMARY OF THE INVENTION

The present invention is directed to a pool lifesaving device, and/or pool lifesaving system, and/or a method for providing pool safety.

A pool lifesaving device includes: a safety net having a center portion and an outer perimeter; at least one weight disposed at the center portion; cable lines engageable with portions of the outer perimeter of the safety net; and motors with spools for winding and unwinding the cable lines.

A pool lifesaving system configured for use with a pool includes: a safety net having a center portion and an outer perimeter; at least one weight disposed at the center portion of the safety net; cable lines engageable with portions of the outer perimeter of the safety net; and motors with spools for winding and unwinding the cable lines; where the safety net is configured to be disposed towards a floor of a pool when the cable lines are in an unwound configuration from the spool; and where the safety net is configured to be disposed above an upper edge of the pool when the cable lines are in a wound configuration from the spool.

A method for providing aiding a person in distress while in a pool, includes: providing a pool lifesaving device or system configured for use with a pool, including: a safety net having a center portion and an outer perimeter; cable lines engageable with portions of the outer perimeter of the safety net; and motors with spools for winding and unwinding the cable lines; where the safety net is configured in a first position to be disposed towards a floor of a pool when the cable lines are in an unwound configuration from the spool; and where the safety net is configured to be disposed in a second position above an upper edge of the pool when the cable lines are in a wound configuration from the spool; and raising the safety net from the first position near the floor of the pool to the second position above the upper edge of the pool to safely raise a distressed person out of water in the pool.

A pool rescue assembly for raising a person who has entered a pool includes: a net-like structure movably positioned across the bottom of the pool, the net-like structure having openings there through, said openings being of sufficient size to allow water passage, but small enough to hold the person who has entered the pool; a motorized device for raising the net above the water surface of the pool; and a sensor device which sends a signal to said motorized device upon said entry of said person into said pool; said motorized device including: a plurality of motors arranged outside the perimeter of the pool; and tethers operatively connected between the motors and said perimetrical locations on the net-like structure; said motors being operable upon receiving a signal from said sensor device to retract said tethers to raise said net-like structure above the water surface of the pool.

These and other features and advantages of the present invention will become apparent from the following detailed description of illustrative embodiments thereof, which is to be read in connection with the accompanying drawings. Corresponding reference element numbers or characters indicate corresponding parts throughout the several views of the drawings.

DETAILED DESCRIPTION OF THE INVENTION

Figure 1:
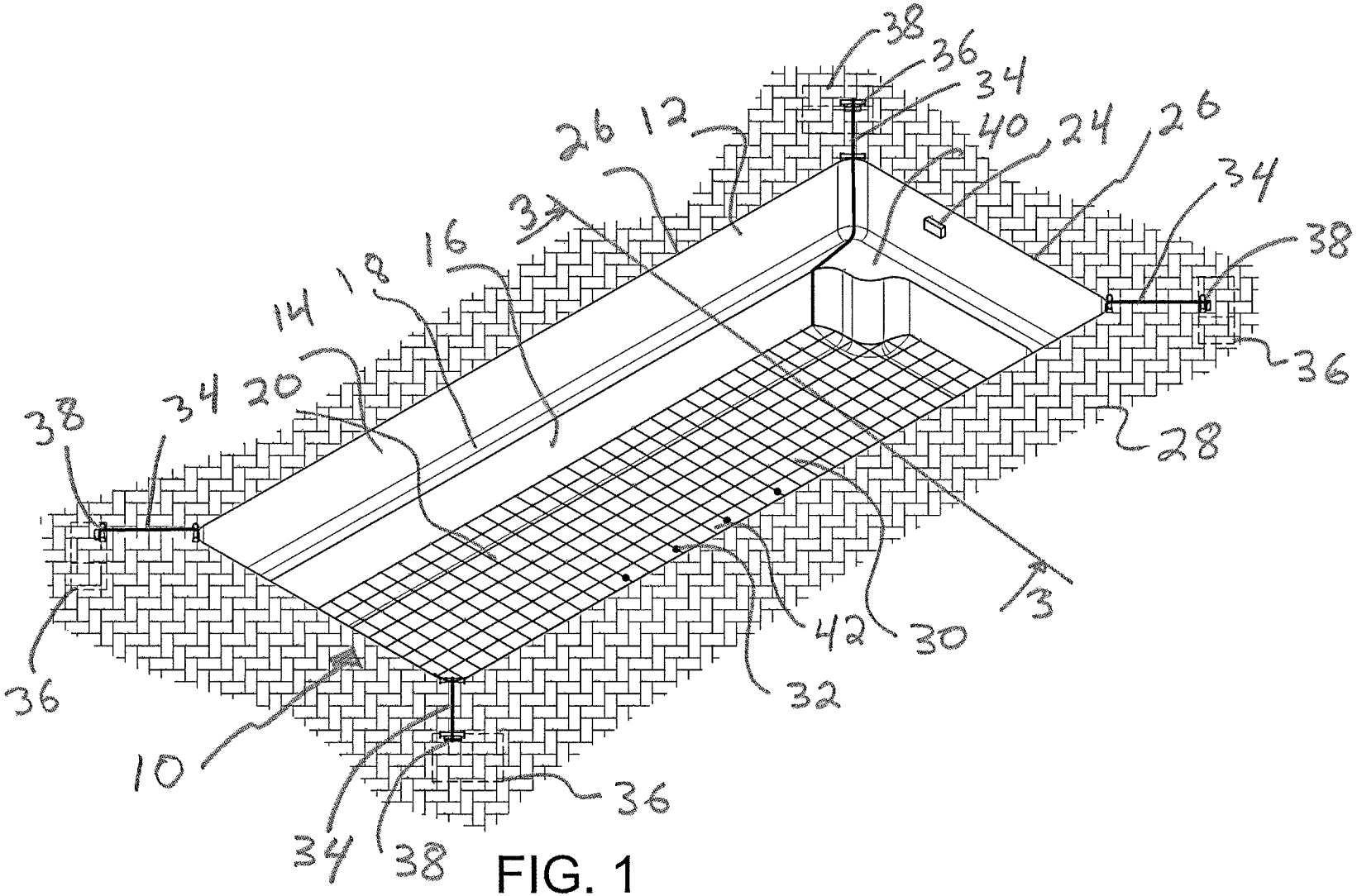
FIG. 1 is a top perspective view of a pool with a pool lifesaving device or system of the present invention having a safety net disposed towards the bottom or floor of the pool.

FIG. 1 is a perspective view of a pool 12, such as an inground pool 12, having a pool lifesaving device or system 10 of the present invention. While the pool 12 is depicted as being perimetrically rectangular, including substantially rectangular, the present invention is not so limited. The pool 12 may have any suitable shaped perimeter or footprint. Further, the pool lifesaving device or system 10 of the present invention is not limited with the use of inground pools. The pool lifesaving device or system 10 of the present invention may be used with above ground pools. Still furthermore, while the pool 12 is depicted as having a flat floor 18, the pool lifesaving device or system 10 of the present invention is not limited with the use of such a flat floor. For example, a pool with a sloped or contoured floor may be used with the pool lifesaving device or system 10 of the present invention.

As depicted in FIG. 1, the pool 12 includes an upper wall 14, a lower wall 16, a ledge 18 therein between, and a floor 18. The pool 12 may include one or more raised corners 22. The ledge 18 and the corners 22 may be useful for ingress to the pool 12 and/or egress from the pool 12. Alternatively, or in addition to, the pool 12 may include stairs (not shown) and/or ladders (not shown) for ingress and egress.

The upper wall 14 defines an upper edge 26 of the pool 12. A deck 28 typically surrounds the upper edge 26 of the pool 12. The inground pool 12 may further include a weir 24 for access of pool water to a pump and/or filtration system (not shown).

As depicted in FIG. 1, the pool lifesaving device or system 10 of the present invention includes a safety net 30 proximally disposed, including juxtaposingly disposed, toward the floor 20 of the pool 12. The safety net 30 is an open mesh configuration, desirably made from polymeric materials, such as but not limited to polyethylene, polypropylene, and the like. The mesh configuration may be an open knitted or woven construction. The filaments forming the safety net 30 may be monofilament or braided. The filaments may be any suitable strength, for example, from about 4 to about 20 pounds. Due to the mesh configuration filament strengths from about 4 pounds to about 8 pounds, preferably about 5 pounds, may be used. The strength of a filament or fishing line is measured in a "pound test" (or lb test). This unit refers to the amount of weight that can be applied to the line. For example, an 8 pound test line could be used to lift an eight-pound object, while a nine-pound object would cause the same line to fail or snap. Cable lines 34 may be secured to portions of the perimeter of the safety net 30, such as the corners 40 of the safety net 30. Desirably, a center portion 42 of the safety net 30 includes weights 32. The weights 32 aid in disposing the safety net 30 towards the pool floor 20 and also, as described below, aid in the safety features of the present invention.

The cable lines 34 are in communication with a motor 38 which may wind the cable lines 34 to advance the safety net 30 above the upper edge 26 of the pool 12 or which may unwind the cable lines 34 to dispose the safety net 30 towards the floor 20 of the pool 12. As depicted in FIG. 1, the pool lifesaving device or system 10 of the present invention may include four cable lines 34, one for each corner 40 of the safety net 30.

Figure 2:
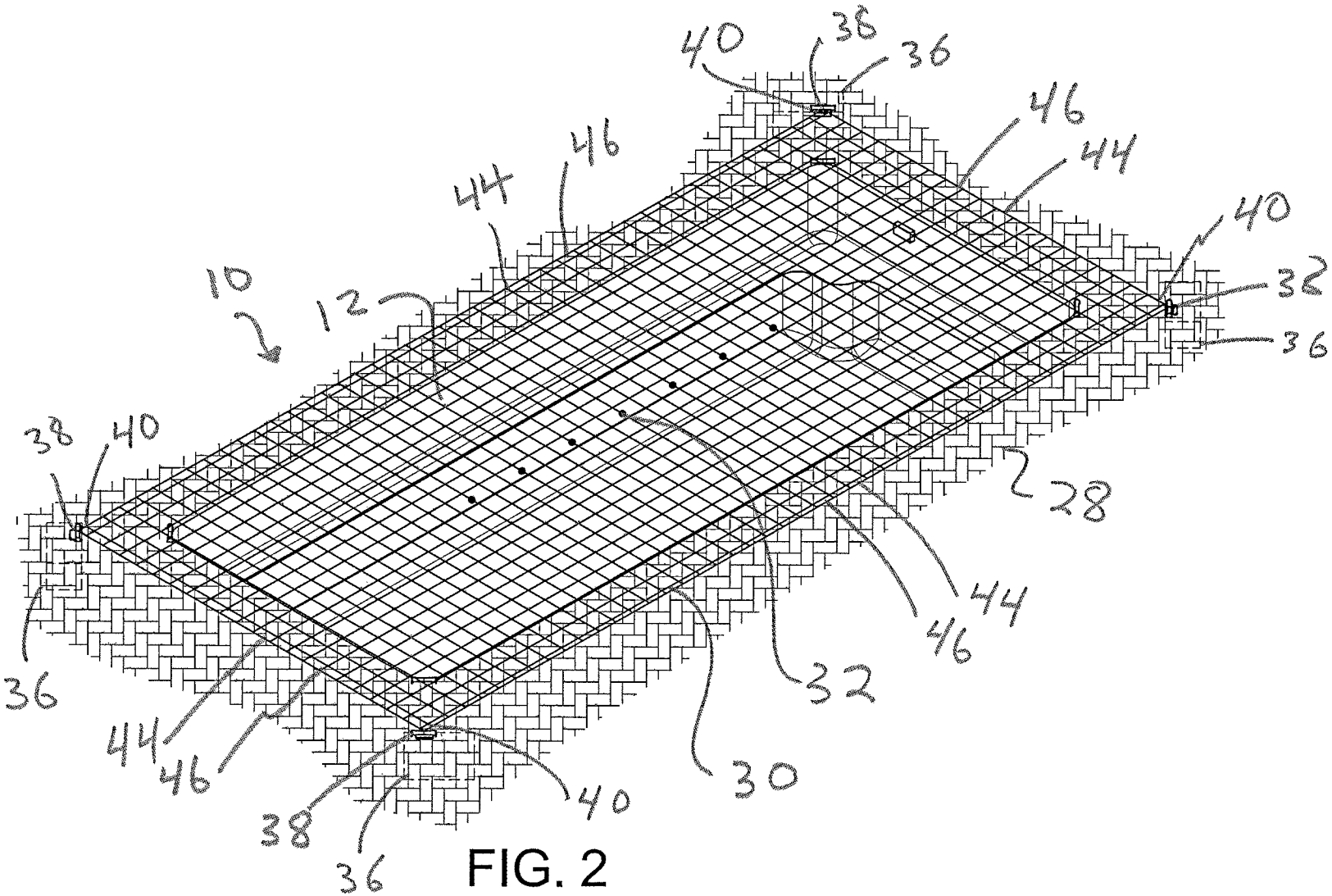
FIG. 2 is a top perspective view of the pool with the pool lifesaving device or system of FIG. 1 having the safety net disposed above the pool perimeter.

FIG. 2 depicted the pool lifesaving device or system 10 of the present invention with the safety net 30 raised above the upper edge 26 of the pool 12. Desirably, the safety net 30 not only extends above the upper edge 26 of the pool 12, but also extends over a portion of the deck 28 surrounding the upper edge 26 of perimeter of the pool 12.

Figure 3:
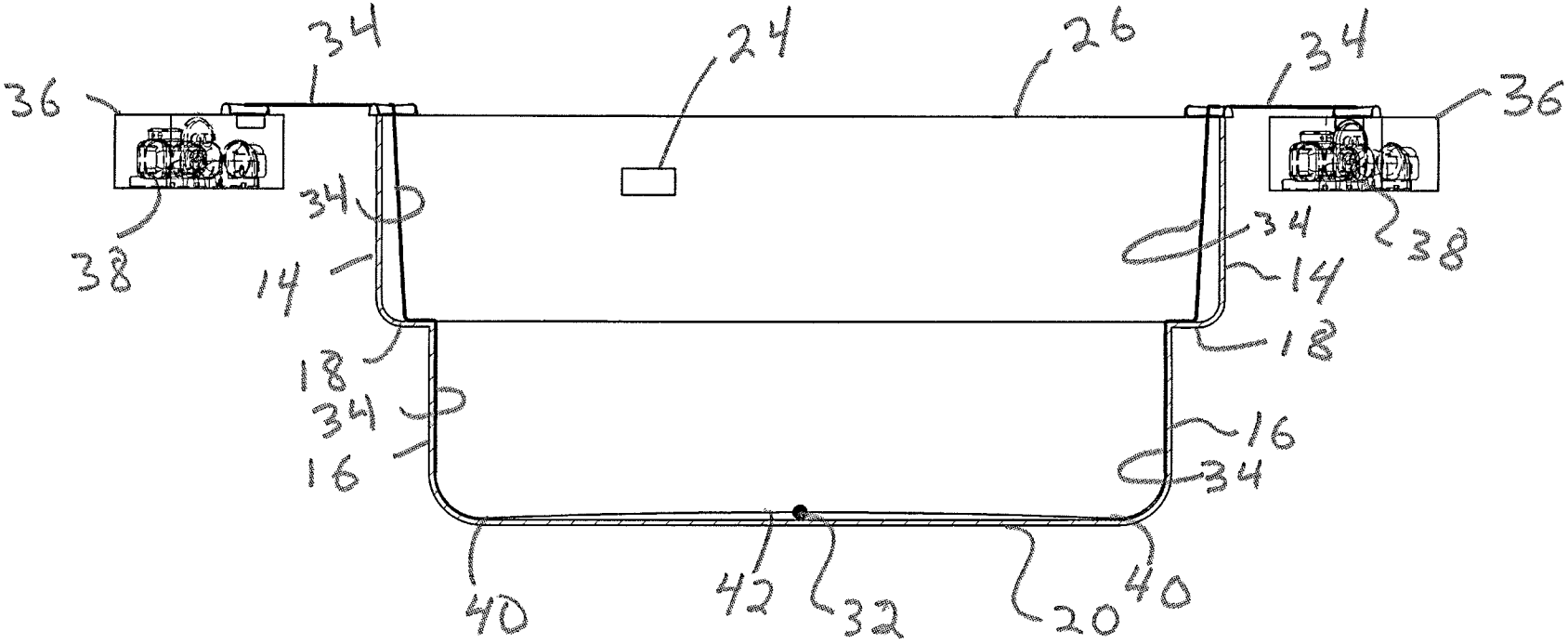
FIG. 3 is a cross-sectional or elevational view of the pool with the pool lifesaving device or system of FIG. 1 taken along the 3-3 axis.

FIG. 3 is a cross-sectional or elevational view of the pool 12 having the safety net 30 proximally and/or juxtaposingly disposed towards the floor 20 of the pool 12. In this "retracted" position of the safety net 30, the pool 12 is configured for normal use, such as swimming, etc. The cable lines 34 are disposed toward the upper and lower walls 14, 16 of the pool 12 so as to not interfere with the intended use of the pool and so as not to provide a safety concern. Guides (not shown) including releasable guides may be provided at the walls 14, 16 for slidably guiding the cable lines 34.

Figure 4:
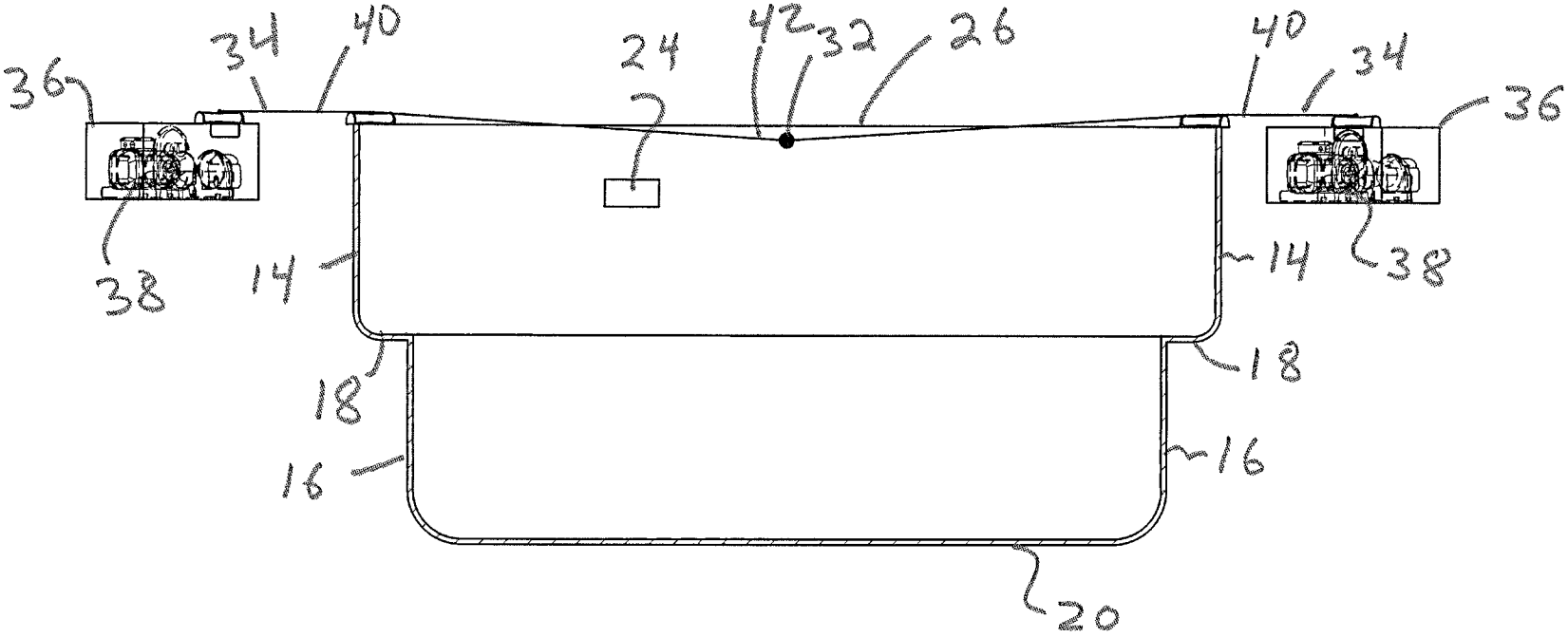
FIG. 4 is a cross-sectional or elevational view of the pool with the pool lifesaving device or system of FIG. 2 taken along the 4-4 axis.

FIG. 4 is a cross-sectional or elevational view of the pool 12 having the safety net 30 advanced to safety position where at least a portion of the safety net 30 is disposed above the upper edge 26 of the pool 12. As depicted in FIG. 4, weights 32 may keep the center portion 42 of the safety net 30 below the upper edge 26 of the pool 12 in a contoured or depressed configuration. This will prevent or act to prevent a person (not shown) from being rolled or otherwise moved off the safety net 30 onto the deck 28 when the safety net 30 is so advanced. A combination of the weights 32 partially holding down the center portion 42 of the safety net 30 and the edges of the perimeter 44 of the safety net 30 extending over and beyond the upper edge 26 of the pool 12 and over a portion of the surrounding deck 28 provides a safety feature for preventing a person from slipping into the pool 12 with the advancement of the safety net 30.

Figure 5:
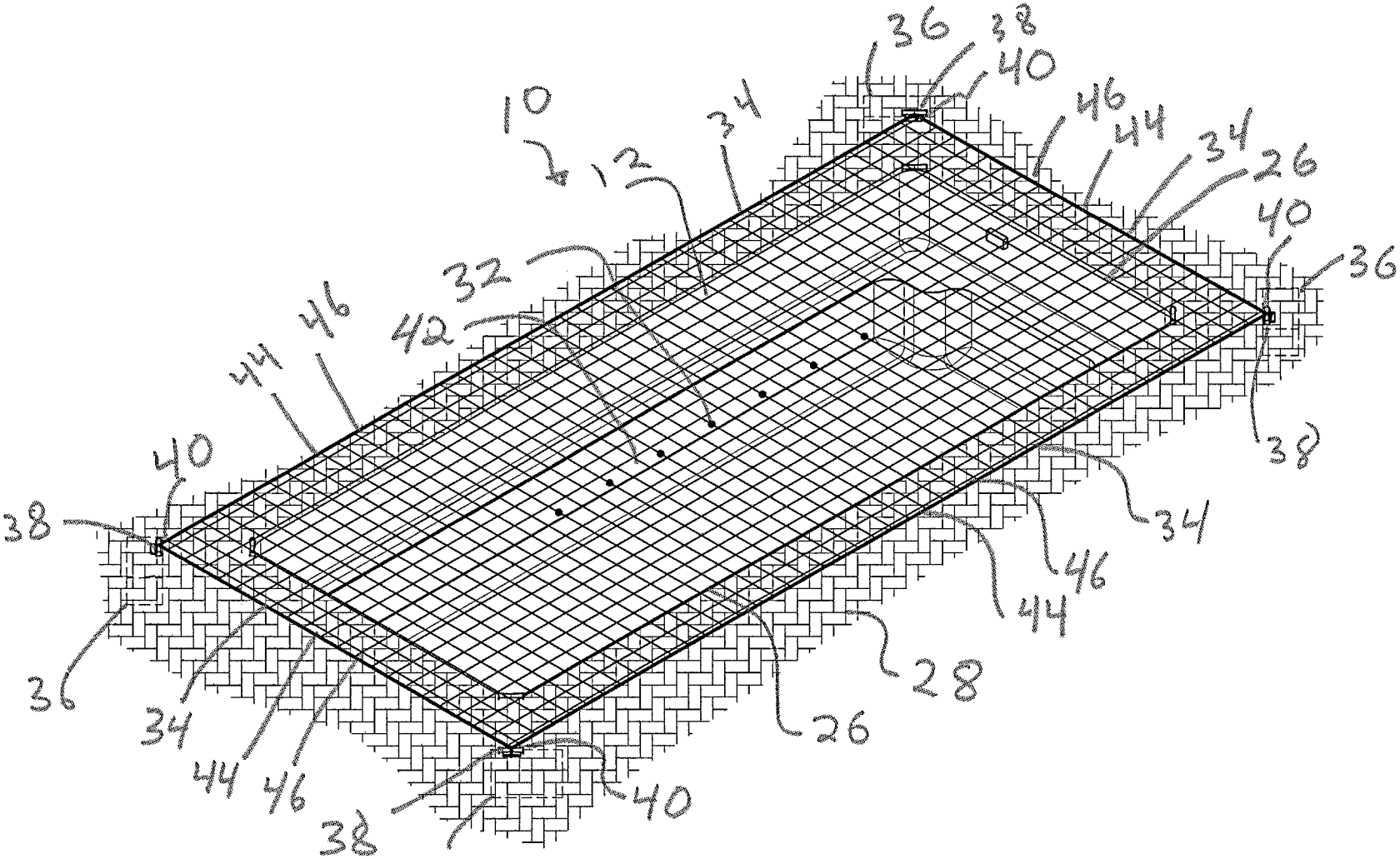
FIG. 5 is a top perspective view of the pool with the pool lifesaving device or system of FIG. 1 having the safety net with a perimeter cable line disposed above the pool perimeter.

FIG. 5 depicts a further embodiment of the pool lifesaving device or system 10. The safety net 30 may optionally include cable lines 34 slidably disposed at perimetric edges 46 of the safety net 30. Such a framed configuration, while not required, may provide yet additional safety and robustness to the pool lifesaving device or system 10 of the present invention.

Figure 6:
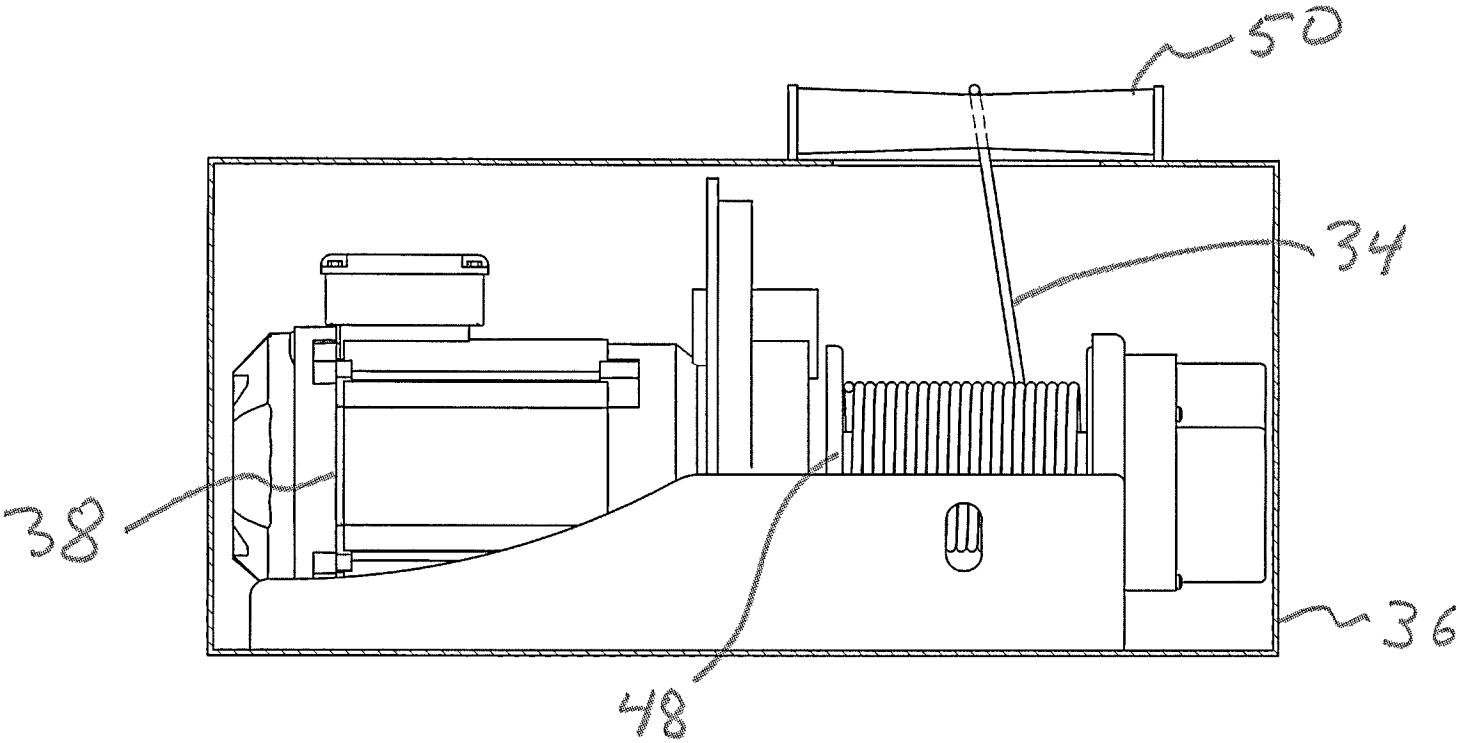
FIG. 6 is an illustration of a motor useful for raising or lowering the safety net according to the present invention.

FIG. 6 illustrates an arrangement for winding (or retracting) the cable lines 34 and for unwinding (or advancing) the cable lines 34. The cable line 34 may be wound or unwound over a spool 48 associated with a motor 38. The spool 48 and the motor 38 may be contained in an enclosure or box 36 for aesthetic and/or safety and/or practical reasons. A guide 50 may be provided to provide a smooth transition of the cable line 34 from the spool 48 to the pool 12. The enclosure or box 36 may be below grade as depicted in the figures. The present invention, however, is not so limited.

The pool lifesaving device or system 10 of the present invention is useful for aiding some one, such as a person, in distress while in the pool 12. The safety net 30 may be advanced from the bottom or floor 20 of the pool 12 to raise a person in distress out of the pool water to prevent, for example, the distressed person from drowning. A person noticing a distressed person in the pool 12 may activate the motors 38 to advance the safety net 30. This could be accomplished by a manual switch or switches (not shown) or accomplished by remote, such as wired or wireless, switches.

The pool lifesaving device or system 10 of the present invention may also be used to prevent injury a person having unauthorized entry into the pool 12. For example, upon detection of unauthorized entry into the pool 12, the pool lifesaving device or system 10 of the present invention may be activated to prevent possible injury. Examples, of systems and assemblies useful for detecting unauthorized entry are disclosed in U.S. Pat. Nos. 10,810,857 B1; 11,348,535 B2; and 11,531,136 B2, the contents of which are incorporated herein by reference, either partially or in their entirety.

A pool rescue assembly 10 for raising a person who has entered a pool 12 includes: a net-like structure 30 movably positioned across the bottom 20 of the pool 12, the net-like structure 30 having openings there through, said openings being of sufficient size to allow water passage, but small enough to hold the person who has entered the pool 12; a motorized device for raising the net 30 above the water surface of the pool 12; and a sensor device which sends a signal to said motorized device upon said entry of said person into said pool 12; said motorized device including: a plurality of motors 38 arranged outside the perimeter 26 of the pool 12; and tethers 34 operatively connected between the motors 38 and said perimetrical locations 44 on the net-like structure 30; said motors 38 being operable upon receiving a signal from said sensor device to retract said tethers 34 to raise said net-like structure 30 above the water surface of the pool 12.

While various embodiments of the present invention are specifically illustrated and/or described herein, it will be appreciated that modifications and variations of the present invention may be effected by those skilled in the art without departing from the spirit and intended scope of the invention. Further, any of the embodiments or aspects of the invention as described in the claims or in the specification may be used with one and another without limitation.

What is claimed is:

1. A pool lifesaving device comprising:

a safety net having a center portion and an outer perimeter;

at least one weight disposed at the center portion;

cable lines engageable with portions of the outer perimeter of the safety net; and motors with spools for winding and unwinding the cable lines;

wherein the at least one weight disposed at the center portion of the safety net is configured to downwardly contour the center portion of the safety net when the cable lines are in a wound configuration on the spools.

2. A pool rescue assembly for raising a person who has entered a pool comprising:

a net-like structure movably positioned across the bottom of the pool, the net-like structure having openings therethrough, said openings being of sufficient size to allow water passage, but small enough to hold the person who has entered the pool, the net-like structure having at least one weight disposed at a center portion of the net-like structure to downwardly contour the center portion of the net-like structure;

a motorized device for raising the net above the water surface of the pool; and a sensor device which sends a signal to said motorized device upon said entry of said person into said pool;

said motorized device including:

a plurality of motors arranged outside the perimeter of the pool; and tethers operatively connected between the motors and perimetrical locations on the net-like structure;

said motors being operable upon receiving a signal from said sensor device to retract said tethers to raise said net-like structure above the water surface of the pool.

3. A pool lifesaving system configured for use with a pool, comprising:

a safety net having a center portion and an outer perimeter;

at least one weight disposed at the center portion of the safety net;

cable lines or tethers engageable with corner portions of the outer perimeter of the safety net; and motors with spools for winding and unwinding the cable lines or tethers;

wherein the safety net is configured to be disposed towards a floor of a pool when the cable lines are in an unwound configuration from the spool;

wherein the safety net is configured to be disposed above an upper edge of the pool when the cable lines are in a wound configuration from the spool; and wherein the at least one weight disposed at the center portion of the safety net is configured to downwardly contour the center portion of the safety net when the cable lines or tethers are in a wound configuration from the spool.

4. The pool lifesaving system of claim 3, wherein the outer perimeter of the safety net is configured to be disposed above the upper edge of the pool and over a portion of a deck surrounding the upper edge of the pool when the cable lines are in a wound configuration from the spool.

5. The pool lifesaving system of claim 3, wherein the safety net is configured to be juxtaposingly disposed to the floor of the pool when the cable lines or tethers are in the unwound configuration from the spool.

6. The pool lifesaving system of claim 3, wherein the cable lines or tethers are slidable disposed at the outer perimeter of the safety net.

7. The pool lifesaving system of claim 3, wherein the motors have on/off switches for activating the motors.

8. The pool lifesaving system of claim 7, wherein the on/off switches are manually operable.

9. The pool lifesaving system of claim 7, wherein the on/off switches are remotely operable.

10. The pool lifesaving system of claim 7, wherein the on/off switches are automatically operable upon detection of a person in distress within the pool.

11. A method for providing aiding a person in distress while in a pool, comprising:

providing a pool lifesaving device or system configured for use with a pool, comprising:

a safety net having a center portion and an outer perimeter;

cable lines or tethers engageable with portions of the outer perimeter of the safety net; and motors with spools for winding and unwinding the cable lines or tethers;

wherein the safety net is configured in a first position to be disposed towards a floor of a pool when the cable lines or tethers are in an unwound configuration from the spool;

wherein the safety net is configured to be disposed in a second position above an upper edge of the pool when the cable lines or tethers are in a wound configuration from the spool;

providing at least one weight disposed at the center portion of the safety net to downwardly contour the center of the safety net to prevent a distressed person sliding or rolling towards the outer perimeter of the safety net in the second position of the safety net; and raising the safety net from the first position near the floor of the pool to the second position above the upper edge of the pool to safely raise a distressed person out of water in the pool.

12. The method of claim 11 further comprising:

moving the outer perimeter of the safety net beyond the upper edge of the pool to over portions of a deck surrounding the pool.

13. The method of claim 11, where in the step raising the safety net further comprises:

activating the motor to raise the safety net.

14. The method of claim 13, further comprising:

manually activating the motor to raise the safety net.

15. The method of claim 13, further comprising:

remotely activating the motor to raise the safety net.

16. The method of claim 13, further comprising:

automatically activating the motor to raise the safety net upon detection of a person in distress in the pool.

* * * * *